US012066234B2

(12) United States Patent
Ogg

(10) Patent No.: US 12,066,234 B2
(45) Date of Patent: Aug. 20, 2024

(54) CARBONATED ICE MAKER AND REFRIGERATOR INCLUDING THE SAME

(71) Applicant: LG Electronics Inc., Seoul (KR)

(72) Inventor: Anthony Ogg, Englewood Cliffs, NJ (US)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/339,644

(22) Filed: Jun. 4, 2021

(65) Prior Publication Data

US 2022/0390162 A1 Dec. 8, 2022

(51) Int. Cl.
*F25C 1/18* (2006.01)

(52) U.S. Cl.
CPC ..... *F25C 1/18* (2013.01); *F25C 2400/10* (2013.01); *F25C 2400/14* (2013.01)

(58) Field of Classification Search
CPC ..... F25C 1/18; F25C 2400/10; F25C 2400/14
See application file for complete search history.

(56) References Cited

U.S. PATENT DOCUMENTS

| | | | | |
|---|---|---|---|---|
| 2,575,509 | A | 11/1951 | Bayston | |
| 3,255,600 | A | 6/1966 | Mitchell et al. | |
| 9,869,502 | B2 | 1/2018 | Gardner et al. | |
| 10,888,825 | B2 | 1/2021 | Jeong et al. | |
| 2012/0104021 | A1* | 5/2012 | Cur | F25D 23/126 99/323.1 |
| 2013/0133524 | A1 | 5/2013 | Vastardis et al. | |
| 2014/0239521 | A1* | 8/2014 | Ergican | B01F 23/236 261/DIG. 1 |
| 2015/0241102 | A1* | 8/2015 | Lee | F25D 23/04 62/344 |

(Continued)

FOREIGN PATENT DOCUMENTS

| | | | |
|---|---|---|---|
| GB | 1095004 | | 6/1965 |
| JP | H0331674 | A * | 2/1991 |

(Continued)

OTHER PUBLICATIONS

Translated_Takahiro (Year: 1991).*

(Continued)

*Primary Examiner* — Elizabeth J Martin
*Assistant Examiner* — Samba Nmn Gaye
(74) *Attorney, Agent, or Firm* — Fish & Richardson P.C.

(57) ABSTRACT

A refrigerator includes a cabinet that defines a refrigerating compartment and a freezing compartment, and an ice maker located at the freezing compartment and configured to generate carbonated ice. The ice maker includes a reservoir configured to store carbonated water that includes dissolved gas, a water line connected to the reservoir and configured to supply non-carbonated water to the reservoir, a gas line connected to the reservoir and configured to, based on the reservoir receiving the non-carbonated water, supply pressurized gas to the reservoir to thereby produce the carbonated water that is stored in the reservoir, a heating element configured to heat the reservoir to a temperature above freezing, and an ice tray configured to receive the carbonated water from the reservoir and to generate the carbonated ice.

18 Claims, 13 Drawing Sheets

(56) References Cited

U.S. PATENT DOCUMENTS

| | | | | |
|---|---|---|---|---|
| 2016/0059192 | A1* | 3/2016 | Jeong | B01F 23/2363 62/344 |
| 2018/0153331 | A1 | 6/2018 | Novak et al. | |
| 2020/0158394 | A1* | 5/2020 | Kim | F25C 1/243 |

FOREIGN PATENT DOCUMENTS

| | | | | |
|---|---|---|---|---|
| JP | H0674626 | A * | 3/1994 | |
| KR | 100517720 | B1 * | 9/2005 | |
| KR | 2017000272 | A * | 1/2017 | F25C 1/22 |

OTHER PUBLICATIONS

Translated_Kato (Year: 1994).*
Translated_Yong (Year: 2005).*
Translated_Woo (Year: 2017).*

* cited by examiner

CARBONATED ICE MAKER AND REFRIGERATOR INCLUDING THE SAME

TECHNICAL FIELD

The present disclosure relates to an ice maker that can generate chewable ice and a refrigerator including the same.

BACKGROUND

Refrigerators are appliances that can cool and store food items. For instance, a storage space defined inside the refrigerator may be cooled using cool air, and the food items may be stored in a refrigerated state or a frozen state.

In some cases, the refrigerator can include an ice maker. For example, water can be supplied automatically from a water supply source to an ice tray to form ice pieces. In some cases, the formed ice pieces may be removed by heating the tray or by physically removing the ice pieces.

In some cases, the ice maker may include a complicated auger system or continuous-loss water system to generate chewable ice. For example, a large mechanical system and a constant-loss water system may include both a water feed to keep supplying clean water and a water drain to keep draining water while generating chewable ice. Additionally, the mechanical motor-driven auger system may be inefficient for home-based consumer systems. Further, the volume of the ice maker system may not be viable to place in a home refrigerator because of a significant volume loss of useable spaces and excessive power consumption.

In some examples, an ice maker may generate carbonated ice. For example, the ice maker may freeze carbonated water containing dissolved carbon dioxide to generate carbonated ice, which includes gas bubbles trapped within the ice during the ice generating process. In some cases, an amount of the carbon dioxide may decrease during generation of the carbonated water and a delivery of the carbonated water to the ice maker.

SUMMARY

According to one aspect of the subject matter described in this application, a refrigerator includes a cabinet that defines a refrigerating compartment and a freezing compartment and an ice maker located at the freezing compartment and configured to generate carbonated ice. The ice maker includes a reservoir configured to store carbonated water that includes dissolved gas, a water line connected to the reservoir and configured to supply non-carbonated water to the reservoir, a gas line connected to the reservoir and configured to, based on the reservoir receiving the non-carbonated water, supply pressurized gas to the reservoir to thereby produce the carbonated water that is stored in the reservoir, a heating element configured to heat the reservoir to a temperature above freezing, and an ice tray configured to receive the carbonated water from the reservoir and to generate the carbonated ice.

Implementations according to this aspect can include one or more of the following features. For example, the pressurized gas can include carbon dioxide. In some implementations, the ice maker can further include a reservoir housing that defines a reservoir groove configured to accommodate the reservoir and a cartridge groove configured to accommodate a gas cartridge that includes the pressurized gas. In some implementations, the ice maker can further include a feed line that is connected to the reservoir housing and extends to the ice tray, where the feed line is configured to supply the carbonated water to the ice tray, and the heating element is spaced apart from the feed line and configured to provide heat to the feed line.

In some implementations, the heating element can include a heating pad that is attached to an outer surface of the reservoir and that faces a wall of the reservoir housing that faces the ice tray, where at least a portion of the feed line can be disposed inside the reservoir housing and extend along the wall and the heating pad. In some examples, the reservoir can include a vent port configured to discharge undissolved gas from the reservoir.

In some implementations, the refrigerator can include a valve assembly disposed at the reservoir housing and configured to control (i) supply of the non-carbonated water to the reservoir through the water line, (ii) supply of the pressurized gas to the reservoir through the gas line, (iii) supply of the carbonated water to the ice tray through the feed line, and (iv) discharge of the undissolved gas from the reservoir. In some examples, the vent port can be inserted into the valve assembly. The valve assembly can include a gas dispense valve connected to the gas cartridge and the gas line and configured to supply the pressurized gas to the gas line based on the reservoir receiving the non-carbonated water and the temperature of the reservoir being greater than or equal to a threshold temperature. The valve assembly can further include a first solenoid valve connected to the water line, a second solenoid valve connected to the vent port and configured to open the vent port to release the undissolved gas in the reservoir, and a third solenoid valve connected to the feed line and configured to open the feed line based on a pressure of the undissolved gas discharged from the reservoir through the vent port.

In some implementations, the reservoir groove of the reservoir housing can be recessed downward relative to an upper surface the reservoir housing facing a ceiling of the freezing compartment, and the reservoir groove can be part of an insulated space that is defined between the ceiling of the freezing compartment and the reservoir housing. The insulated space can be surrounded by the reservoir housing, and the heating element can be configured to provide heat to the insulated space. In some examples, the cartridge groove can be recessed upward relative to a lower surface the reservoir housing that is spaced apart from the ceiling of the freezing compartment, where the reservoir housing can be configured to accommodate an upper portion of the gas cartridge in a state in which a lower portion of the gas cartridge is exposed to the freezing compartment.

In some implementations, the ice tray can define a plurality of ice cells configured to receive the carbonated water and to form the carbonated ice in a cylindrical shape. In some examples, the ice tray can be made of silicone. In some examples, the ice maker can further include an ejector panel that extends downward relative to a bottom surface of the ice tray, where the ejector panel includes a plurality of pins that extend toward the reservoir. The ice tray can be configured to rotate toward the ejector panel, and the plurality of pins can be configured to push the bottom surface of the ice tray based on the ice tray rotating toward the ejector panel to thereby release the carbonated ice from the ice tray.

In some implementations, a volume of the reservoir corresponds to a volume of the plurality of grooves.

In some implementations, the reservoir housing can extend in a direction toward a rear surface of the cabinet and be configured to receive the gas cartridge in the direction toward the rear surface of the cabinet. The reservoir housing can be configured to hold the gas cartridge in a state in which a front end of the gas cartridge protrudes outside the reservoir housing toward a door of the freezing compartment.

In some implementations, a carbonation ratio of a gas weight of the dissolved gas with respect to a liquid volume of the carbonated water stored in the reservoir is greater than or equal to 2.5 g/L. In some examples, the heating element can be configured to control an amount of heat supplied to the reservoir to control the carbonation ratio by maintaining a temperature of the reservoir to be greater than a freezing temperature of the carbonated water. In some examples, the reservoir housing can define an upper opening that faces the ceiling of the freezing compartment, and at least a portion of the heating element can be exposed to the upper opening and face the ceiling of the freezing compartment.

In some implementations, the reservoir housing can further define a front opening configured to receive the reservoir, and the ice maker can include a front cover configured to cover a front side of the reservoir that is received in the reservoir housing. In some examples, the front cover can be configured to be positioned rearward relative to a front end of the gas cartridge.

BRIEF DESCRIPTION OF THE DRAWINGS

Like reference symbols in the various drawings indicate like elements.

DETAILED DESCRIPTION

Figure 1A:
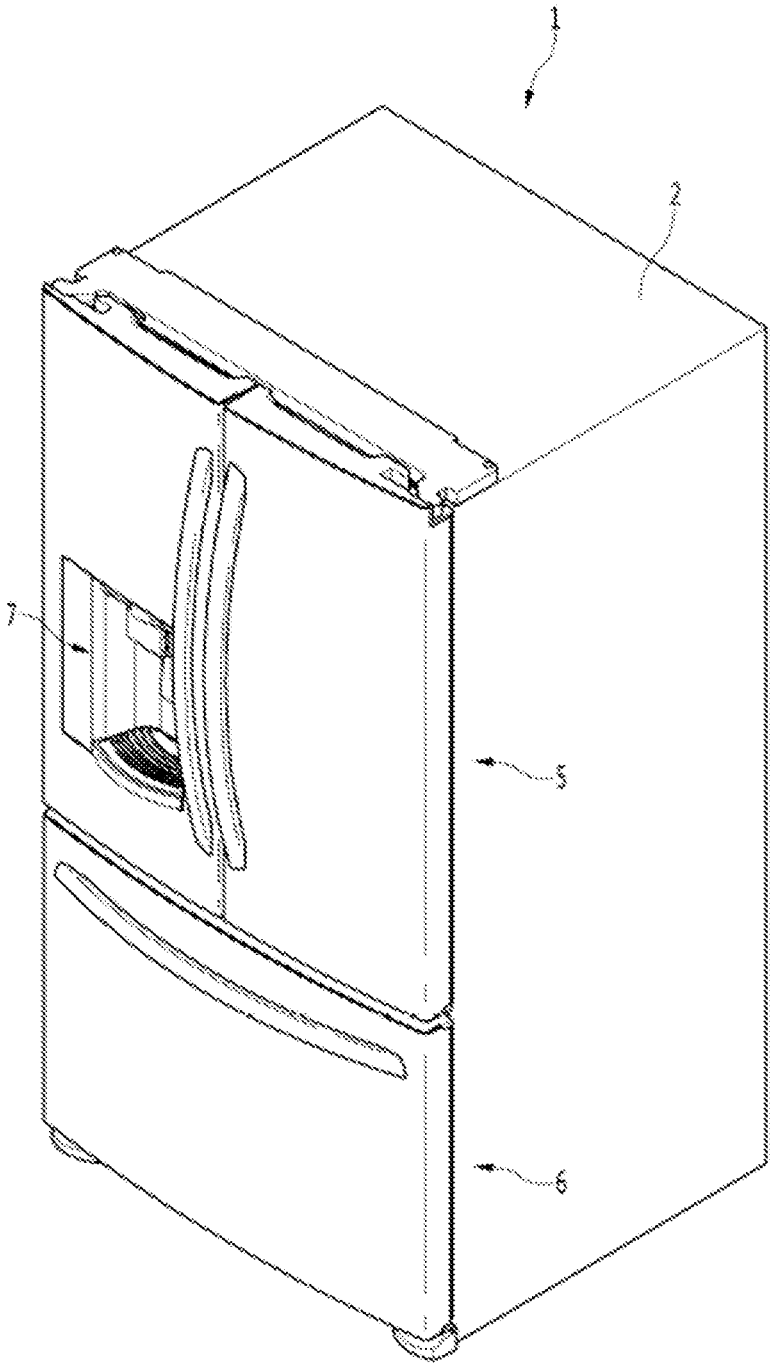
FIG. 1A is a perspective view illustrating an example refrigerator.
Figure 1B:
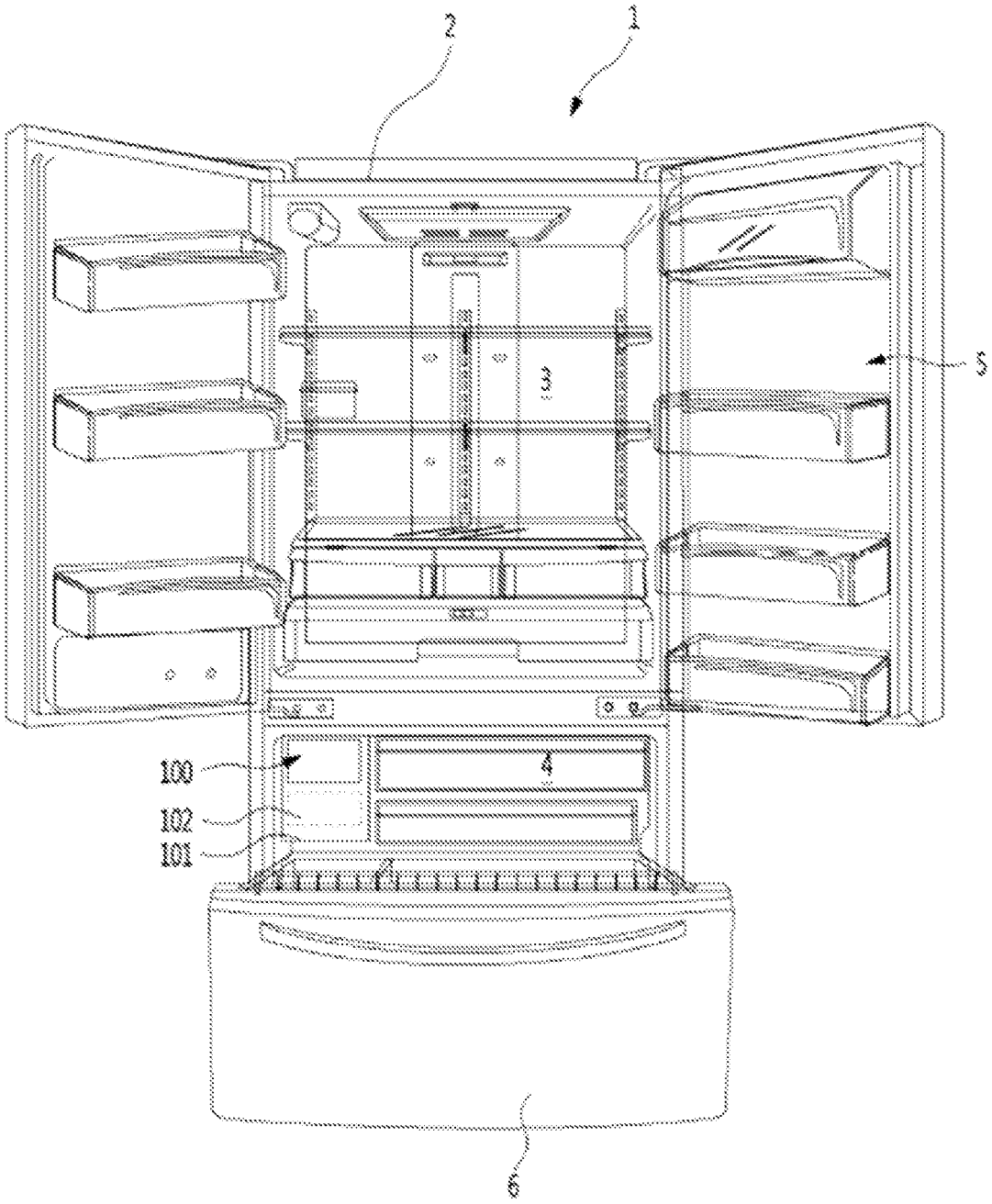
FIG. 1B is a front view illustrating an example state in which doors of the refrigerator of FIG. 1A are opened.

Referring to FIGS. 1A and 1B, a refrigerator 1 can include a cabinet 2 that defines a storage space for storing items, for example food items. In some cases, the cabinet 2 can define a refrigerating compartment 3 at an upper portion of the storage space and a freezing compartment 4 at a lower portion of the storage space. Various accommodation members such as a drawer, a shelf, a basket, and the like can be provided in the refrigerating compartment 3 and the freezing compartment 4.

In some implementations, one or more doors can be provided to open and close the storage space of the refrigerator 1. For example, a refrigerating compartment door 5 can be provided to open and close the refrigerating compartment 3, and a freezing compartment door 6 can be provided to open and close the freezing compartment 4. As illustrated in FIG. 1B, in some examples, the refrigerating compartment door 5 can include left and right doors that are configured to swing open, and the freezing compartment door 6 can be part of a drawer that is configured to be inserted and withdrawn from the freezing compartment 4.

The refrigerating compartment 3 and the freezing compartment 4 can be arranged in various alternative ways, as readily apparent to those of ordinary skill in the art. For example, the refrigerating and freezing compartments can be arranged side by side. In some cases, the freezing compartment can be positioned above the refrigerating compartment.

As illustrated in FIG. 1B, in some implementations, the refrigerator 1 can include an ice maker 100 that is provided in the freezing compartment 4. The ice maker 100 is configured to make ice by using supplied water. As explained further below, in some implementations, the supplied water can be carbonated water including dissolved gas (e.g., carbon dioxide) such that the ice maker 100 can generate carbonated ice or chewable ice. For instance, the carbonated ice can include gas bubbles that are trapped within the ice while the supplied water is solidified in the ice maker 100. The ice can have various shapes such as a cylindrical shape, a cubic shape, a prism shape, or a spherical shape according to a shape of an ice tray. In some implementations, the ice maker 100 can be provided in the refrigerating compartment door 5, the freezing compartment door 6, or the refrigerating compartment 3.

In some examples, an ice bin 102 can be provided to receive and store ice generated by the ice maker 100. The ice maker 100 and the ice bin 102 can be provided in an ice maker housing 101. The ice maker 100 and the ice bin 102 can be removed, for example, for servicing or replacement. The ice made by the ice maker 100 can be obtained by a user by, for example, opening the corresponding door to gain access to the ice bin 102. Alternatively, or in addition, the refrigerator 1 can include a dispenser 7 configured to dispense at least one of water or ice. The dispenser 7 can be provided at an external side of the refrigerating compartment door 5 or the freezing compartment door 6. A transfer passage (e.g., a duct) can be used to transfer the ice stored in the ice bin 102 to the user via the dispenser 7. In some implementations, the dispenser 7 is configured to, based on a user input, discharge non-carbonated water, carbonated water, solid ice generated from the non-carbonated water, or chewable ice generated from the carbonated water.

The refrigerating compartment 3 can be maintained in a refrigerating temperature above 0° C. For example, the refrigerating temperature can be in a range between 0° C. and 10° C. The freezing compartment 4 can be maintained in a freezing temperature that is less than or equal to 0° C. (e.g., −20 to −10° C.) to thereby keep stored items in a frozen state and to generate ice from supplied liquid such as carbonated water or non-carbonated water.

The non-carbonated water can include water supplied directly from an external water source such as tap water. In some implementations, the non-carbonated water can include filtered water or purified water that has passed through a filter disposed in the refrigerator 1. In some cases, the filter can be disposed outside the refrigerator 1 and supply the filtered water to the refrigerator 1. The non-carbonated water can be distinguishable from carbonated water (e.g., sparkling water) that includes dissolved gas. In some cases, the non-carbonated water may also include some amount of dissolved gas that may be naturally occurring and is less than the amount of dissolved gas in carbonated water.

For instance, carbonated water can include carbon dioxide ($CO_2$) dissolved in the non-carbonated water. Sparkling water and soft drinks are some examples of carbonated water. A carbonation ratio of a gas weight of dissolved carbon dioxide with respect to a liquid volume of carbonated water can be in a range between 1 g/L and 8 g/L. For instance, the carbonation ratio can be greater than or equal to 3.5 g/L. In some cases, the carbonation ratio can be greater than 2.5 g/L and less than 3.5 g/L. The carbonation ratio depends on at least one of a temperature or a gas pressure in a container of carbonated water. For example, the carbonation ratio can increase based on a decrease of the temperature of the container and an increase of the pressure in the container. In some cases, non-carbonated water may include little dissolved gas that is less than a threshold carbonation ratio.

In general, a freezing temperature of liquid decreases as the concentration of dissolved gas in the liquid increases. In the case of carbonated water, carbon dioxide dissolved in water can change the freezing temperature slight below 0° C. For instance, the freezing point of carbonated water can be less than −1° C. or between −1° C. and 0° C. In addition, a freezing rate or speed of carbonated water can be slower than a freezing rate of non-carbonated water because the carbonated water has a lower thermal conductivity than the non-carbonated water. Thus, in some examples, generating carbonated ice can take longer than generating non-carbonated ice with the same amount of liquid.

Figure 2:
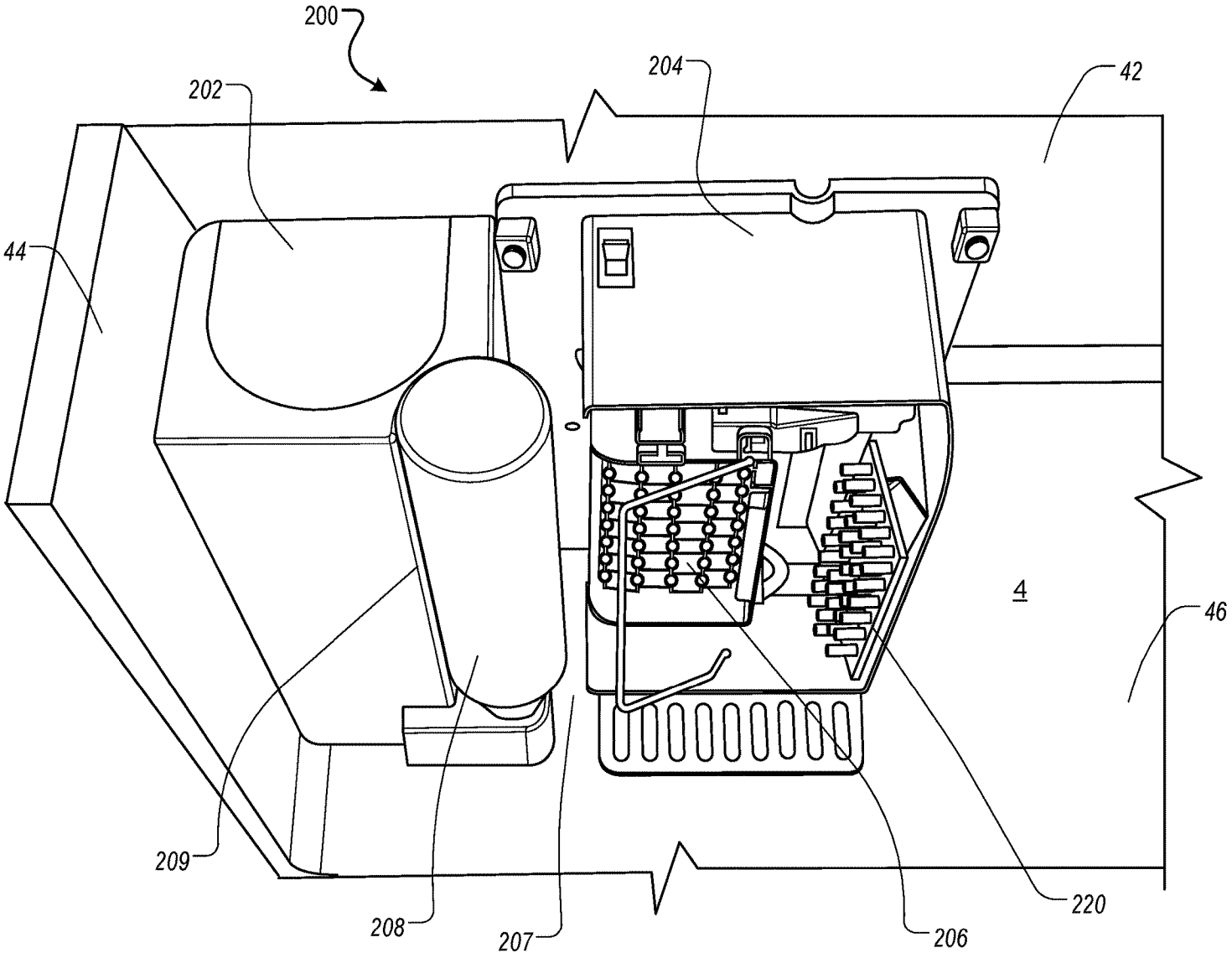
FIG. 2 is a perspective view illustrating an example of an ice maker located in a freezing compartment.
Figure 3:
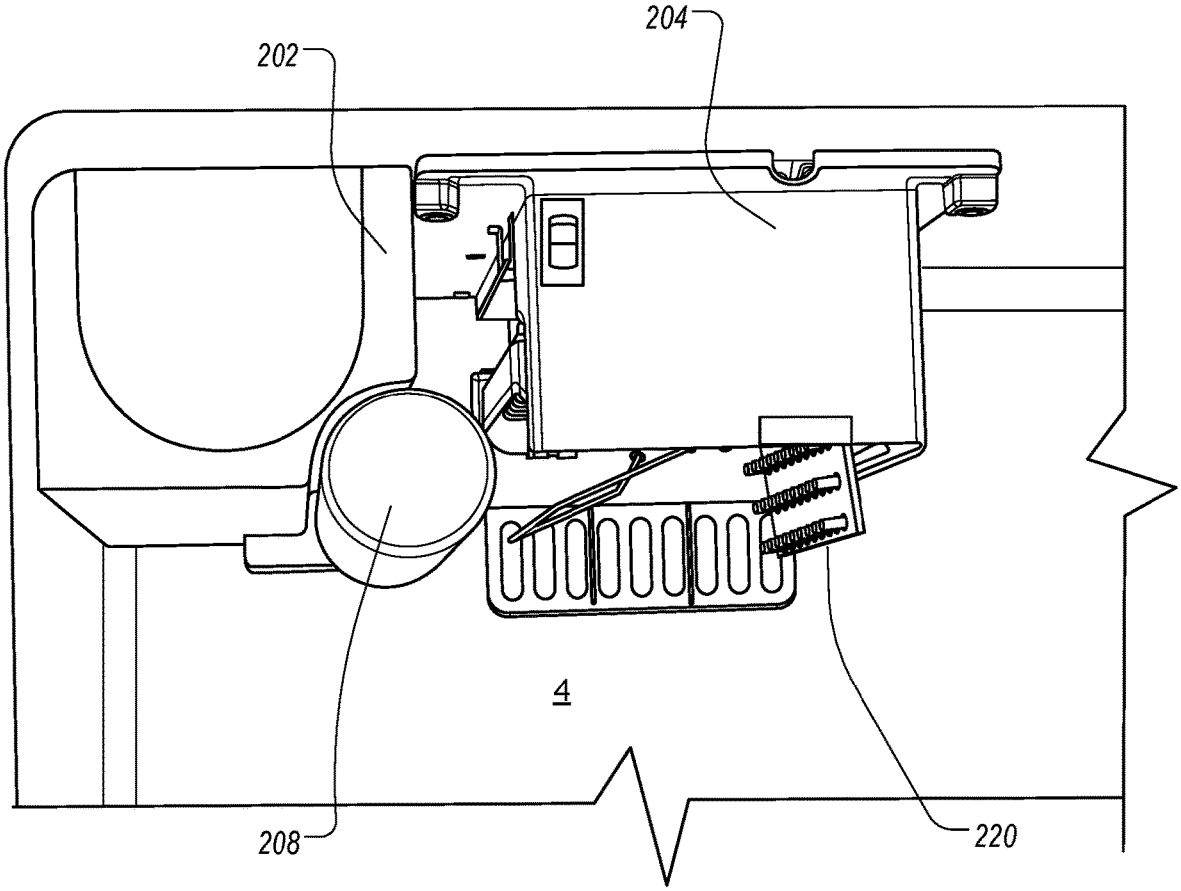
FIG. 3 is a front view illustrating examples of an insulated reservoir housing, an ice tray housing, and a gas cartridge that are located at the ice maker.

FIGS. 2 and 3 illustrate an example of an ice maker 200. In some implementations, the ice maker 200 can be disposed in the freezing compartment 4. In some cases, the ice maker 100 shown in FIG. 1B can be replaced with the ice maker 200, the ice maker 100 can have a structure similar to that of the ice maker 200.

In some examples, the ice maker 200 can be installed at a ceiling surface 42, a lateral side wall 44, or a rear wall of the freezing compartment 4. The ice maker 200 can include a reservoir housing 202 and an ice tray housing 204 that are disposed next to each other. In some implementations, placing the reservoir housing 202 and the ice tray housing 204 next to each other in the freezing compartment 4 can help to provide an efficient supply of the carbonated water to the ice tray 206. A short delivery distance from the reservoir housing 202 to the ice tray housing 204 can help to maintain a liquid state of carbonated water and a carbonation ratio of carbonated water until the carbonated water reaches an ice tray 206 disposed in the ice tray housing 204. For example, if the delivery distance is longer than a preset distance, the carbonated water may release some portion of dissolved gas or turn into a frozen state before the carbonated water reaches the ice tray 206. Alternatively or in addition, a length of a delivery passage, which carries the carbonated water to the ice tray 206, can be minimized to achieve the short delivery distance as described below with greater detail.

In some examples, the reservoir housing 202 can define an insulated space configured to accommodate a reservoir 210. For example, upper ends of the reservoir housing 202 and the ice tray housing 204 can be attached to and in contact with the ceiling surface 42 of the freezing compartment 4 to thereby define the insulated space in the reservoir housing 202. The upper end of the ice tray housing 204 can laterally extend toward to extend the contact area of the upper end of the reservoir housing 202. The insulated space in the reservoir housing 202 can help to maintain a temperature of the reservoir 210 above a temperature of the freezing compartment 4 such that water in the reservoir 210 remains in a liquid state.

In some examples, lower portions of the reservoir housing 202 and the ice tray housing 204 can be spaced apart from each other to thereby define an accommodation space 207 configured to receive a gas cartridge 208. In some implementations, the reservoir housing 202 can define a cartridge groove 209 recessed from a corner facing the accommodation space 207.

The gas cartridge 208 can include pressurized gas such as carbon dioxide. In some implementations, the gas cartridge 208 can be provided as a consumable component and replaced when the pressurized gas is used up for generating carbonated water or carbonated ice. Since carbon dioxide is a non-toxic and inert gas and has a relatively high solubility, carbon dioxide can be used to generate carbonated water. In addition, carbon dioxide can be provided in a form of a canister or a cartridge at an affordable cost. However, in some cases, carbonated water can include other kinds of dissolved gases such as nitrogen, oxygen, inert gases, etc. based on their solubility at a given water temperature and gas pressure. The gas cartridge 208 can have a cylindrical shape, and an outlet of the gas cartridge 208 can be inserted into the reservoir housing 202. In some examples, a central axis of the gas cartridge 208, which has a cylindrical shape, can be orthogonal to a front surface of the door 5 and pass through the front surface of the door 5.

Figure 4A:
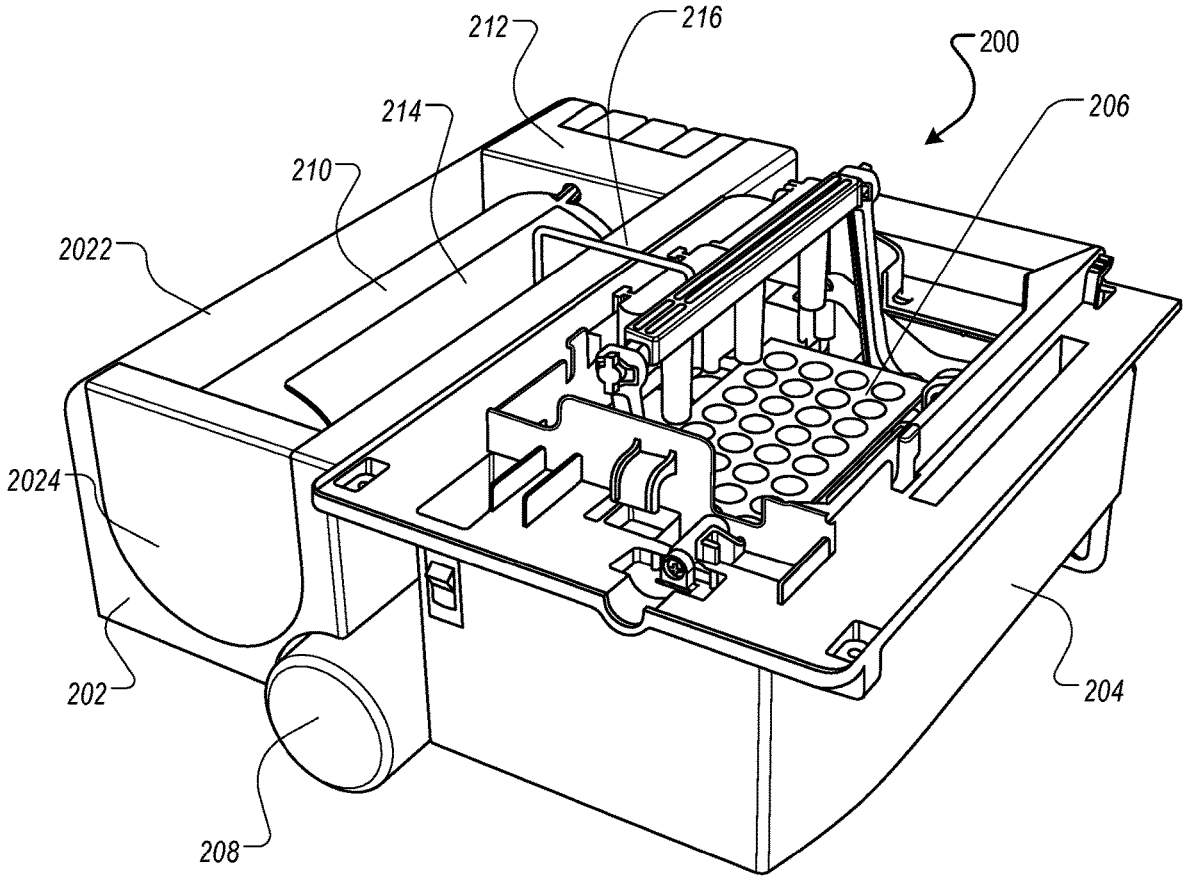
FIG. 4A is a top perspective view illustrating the ice maker.
Figure 4B:
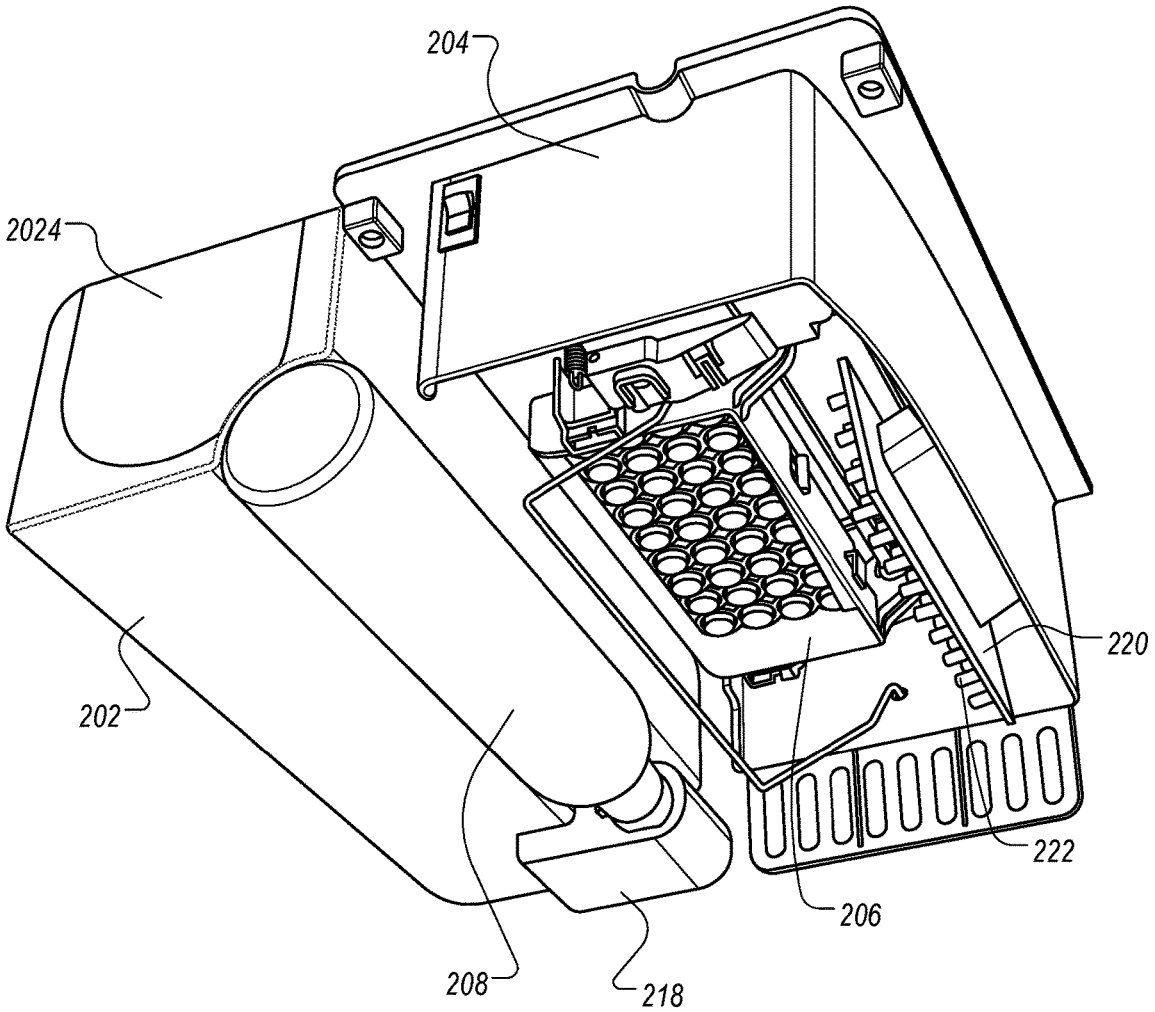
FIG. 4B is a bottom perspective view illustrating the ice maker.
Figure 5:
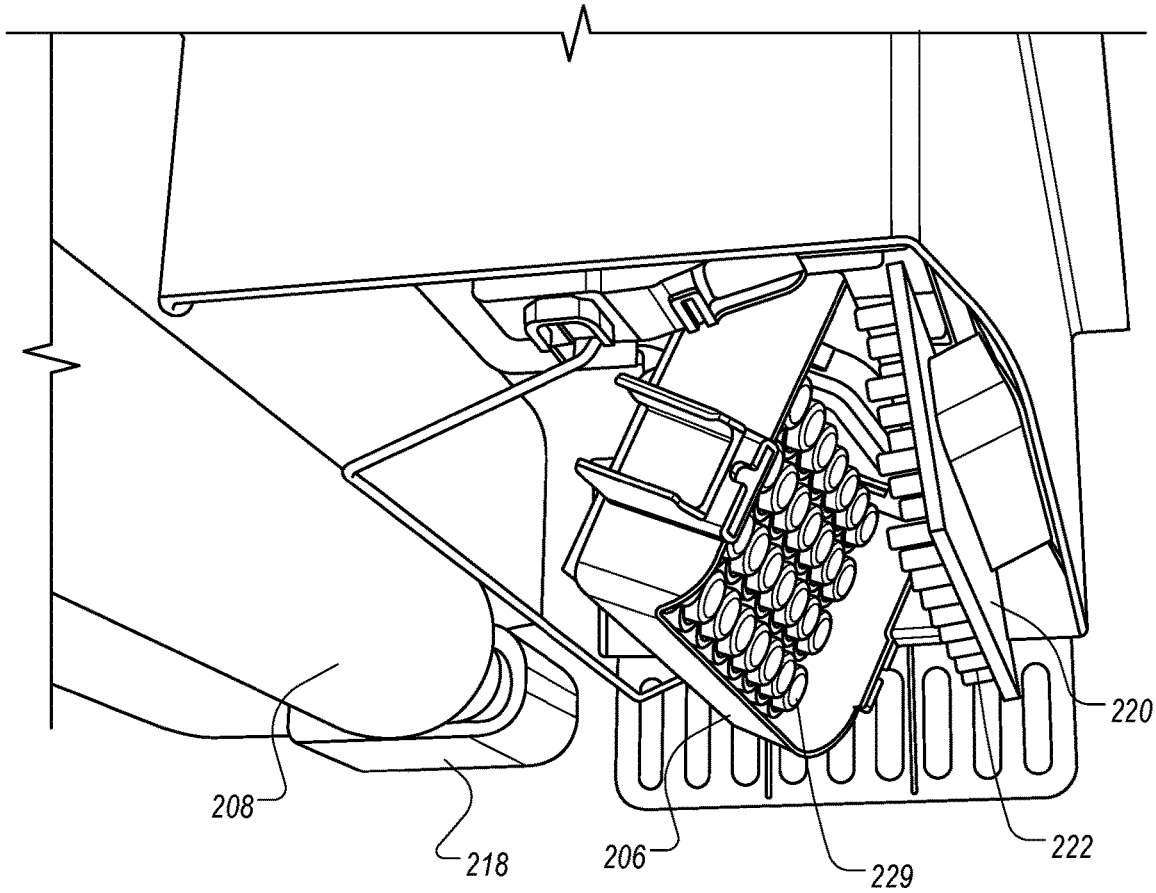
FIG. 5 is a bottom perspective view illustrating an example of an ice tray of the ice maker of FIG. 2 that is in a rotated toward an example ejector panel.

FIGS. 4A, 4B, and 5 are perspective views showing the ice maker 200. The reservoir housing 202 accommodates the reservoir 210 configured to store carbonated water including dissolved gas supplied from the gas cartridge 208. The ice tray housing 204 accommodates the ice tray 206 configured to receive the carbonated water from the reservoir 210 and to generate carbonated ice from the carbonated water. The reservoir 210 can have a cylindrical shape. In some examples, the reservoir 210 can be made of a transparent or translucent material such that an interior of the reservoir 210 is visible from an outside of the reservoir 210. For example, the reservoir 210 can be made of a transparent plastic material or glass.

The reservoir housing 202 can further include a valve assembly 212 that is disposed at a rear end of the reservoir housing 202 and connected to the reservoir 210 and the gas cartridge 208. For example, the reservoir housing 202 can further include a connector 218 that protrudes relative to a bottom surface of the reservoir housing 202 and faces the cartridge groove 209, where the connector 218 can receive an outlet end 2082 (see FIG. 8) of the gas cartridge 208. In some cases, the connector 218 can further protrude laterally relative to a side surface of the reservoir housing 202. In some examples, the connector 218 can cover a portion of the bottom surface of the reservoir housing 202. In some cases, the reservoir housing 202 can further include a front cover 2024 that covers a front side of the reservoir housing 202. The front cover 2024 can include a plate having a curved lower surface coupled to the front side of the reservoir housing 202.

Referring to FIG. 5, the ice tray housing 204 can further include an ejector panel 220 having a plate shape and a plurality of ejector pins 222 that protrude from the ejector panel 220. The ejector panel 220 can be disposed at an inner side of the ice tray housing 204 away from the reservoir housing 202. The ice tray 206 can be configured to rotate toward the ejector panel 220 such that the plurality of ejector pins 222 contact and push a bottom surface of the ice tray 206 to thereby eject chewable ice from the ice tray 206. In some implementations, the ejected ice can fall into and be stored in the ice bin 102 illustrated in FIG. 1B.

In some implementations, the ice maker 200 can further include a heating element 214 configured to heat the reservoir 210 to a temperature above freezing. For example, the heating element 214 can include a heating pad that is attached to an outer surface of the reservoir 210 and configured to supply heat to the reservoir 210 based on receiving electric current. In some examples, the heating element 214 can include an electric circuit or a metal wire configured to generate heat based on carrying electric current. The heating element 214 can be made of or covered by a flexible material such as plastic, fabric, rubber, or the like. In some examples, the heating element 214 can be configured to deform according to a shape of the reservoir 210 to thereby contact an outer circumferential surface of the reservoir 210. Alternatively, in some cases, the heating element 214 can have a predetermined shape that matches the shape of the reservoir 210, and the heating element 214 may not deform according to the shape of the reservoir 210. For instance, the heating element 214 can have a curved shape having a radius of curvature that is equal to a radius of the reservoir 210.

The heating element 214 can extend along the outer circumferential surface of the reservoir 210 in an axial direction of the reservoir 210. A length of the heating element 214 can be less than or equal to a length of the reservoir 210 in the axial direction of the reservoir 210. For example, the heating element 214 can cover a middle portion of the reservoir 210 between a front portion and a rear portion of the reservoir 210, where the front portion and the rear portion of the reservoir 210 can be exposed outside the heating element 214. In some examples, the heating element 214 can be configured to increase an amount of heat based on an increase of a contact surface area between the reservoir 210 and the heating element 214. In some cases, the heating element 214 can be configured to maintain the amount of heat regardless of a size of the contact surface area between the reservoir 210 and the heating element 214.

In some implementations, the heating element 214 can include a plurality of heating elements that are attached to a plurality portions of the ice maker 200. For instance, the plurality of heating elements can be spaced apart from one another and attached to a lower portion of the reservoir 210 that faces a bottom surface of the reservoir housing 202 and an upper portion of the reservoir 210 that faces an open top surface of the reservoir housing 202.

In some implementations, the heating element 214 can be spaced apart from an outer surface of the reservoir 210 and configured to radiate heat toward the reservoir 210. For example, the heating element 214 can be attached to an inner surface of the reservoir housing 202 and face the reservoir 210 with a gap defined therebetween. That is, in some examples, the heating element 214 may not actually contact the reservoir 210, and the heating element 214 can heat an insulated space in the reservoir housing 202 to thereby indirectly heat the reservoir 210. In some cases, the heating element 214 can include a first heating element attached to the outer surface of the reservoir 210 and a second heating element attached to the inner surface of the reservoir housing 202.

Figure 6A:
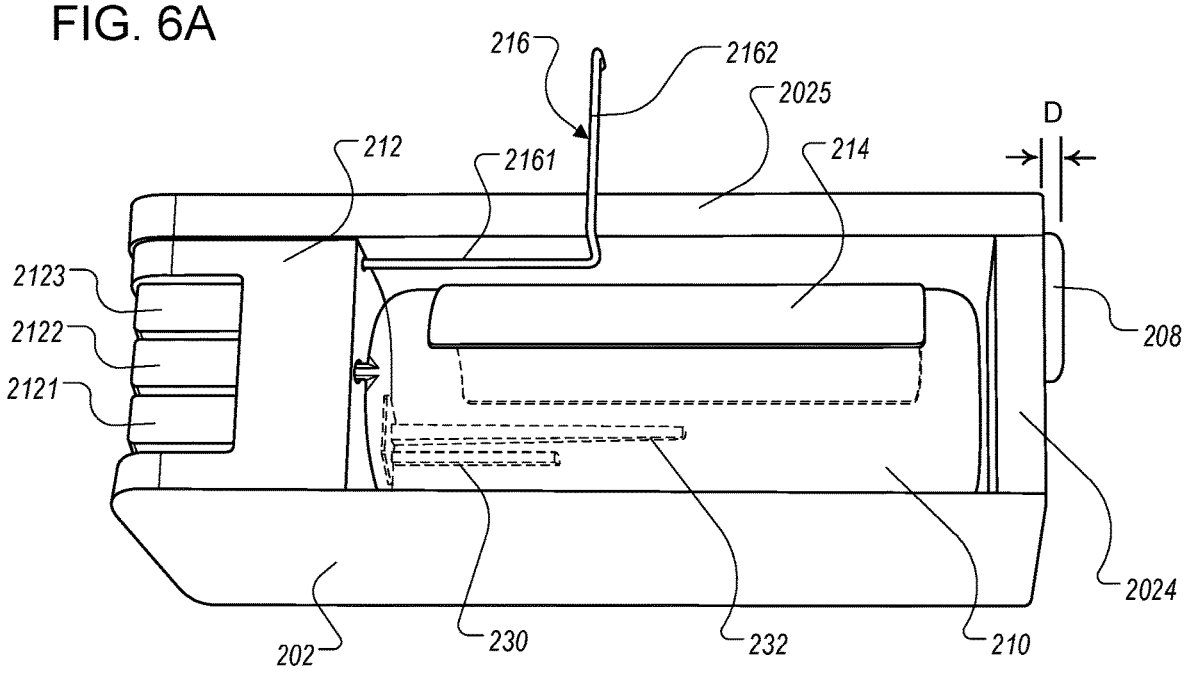
FIGS. 6A and 6B are perspective views illustrating examples of a reservoir, a heating element on the reservoir, and a valve assembly.
Figure 6B:
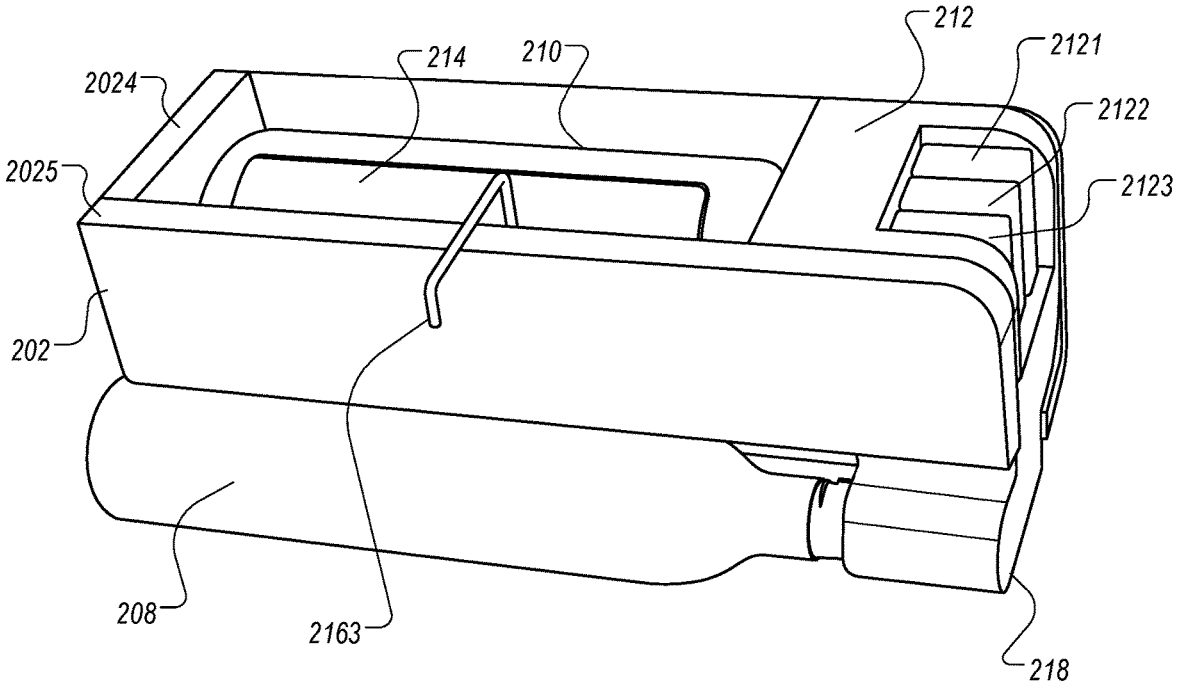
Figure 7:
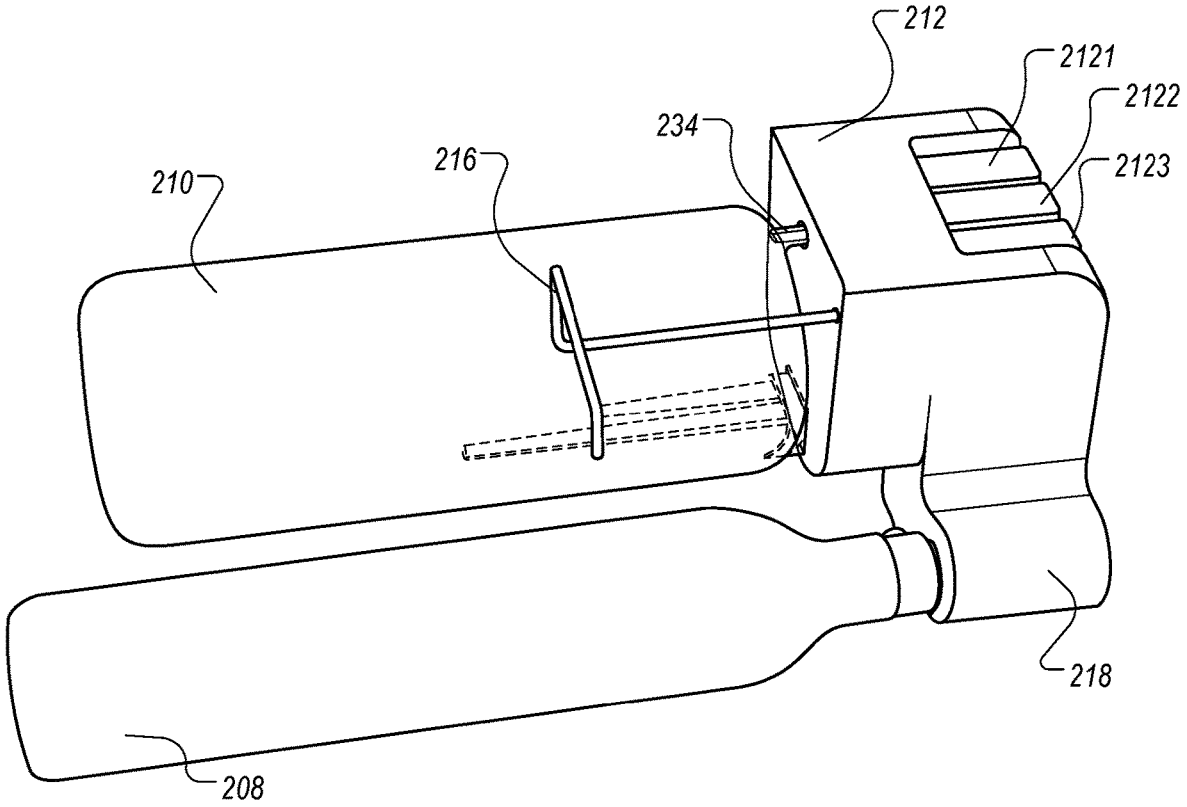
FIG. 7 is a perspective view illustrating the reservoir and the gas cartridge coupled to the valve assembly.

FIGS. 6A and 6B illustrate examples of the reservoir 210, the heating element 214 on the reservoir 210, and the valve assembly 212 that are disposed at the reservoir housing 202. FIG. 7 illustrates the reservoir 210 and the gas cartridge 208 installed at the valve assembly 212.

Referring to FIGS. 6A, 6B, and 7, in some implementations, the heating element 214 can cover a portion of the reservoir 210. For example, the heating element 214 can be disposed only at a first side with respect to an axis of the cylindrical shape of the reservoir 210, where the first side faces the ice tray housing 204, and a second side of the reservoir 210 with respect to the axis of the reservoir 210 faces opposite to the ice tray housing 204. The heating element 214 can face an inner wall of the reservoir housing 202 adjacent to the ice tray housing 204. In some examples, the axis of the cylindrical shape of the reservoir 210 can be parallel to the central axis of the gas cartridge 208, which has a cylindrical shape.

In some implementations, the ice maker 200 can further include a feed line 216 that is connected to the valve assembly 212 and extends above the ice tray 206. For example, the feed line 216 can include a pipe or a tube configured to supply carbonated water stored in the reservoir 210 to the ice tray 206. In some examples, the feed line 216 can be spaced apart from the heating element 214 and configured to receive some of heat generated from the heating element 214. For instance, a least a portion of the feed line 216 can be disposed inside the reservoir housing 202 and extend along the inner wall of the reservoir housing 202, which faces the ice tray housing 204, to thereby overlap with a portion of the heating element 214.

In some examples, the feed line 216 can define a delivery passage configured to carry the carbonated water to the ice tray 206 and have a preset length. As discussed above, in relation with the close arrangement of the reservoir housing 202 and the ice tray housing 204, the preset length of the feed line 216 can be minimized to achieve the short delivery distance between the reservoir housing 202 and the ice tray housing 204. The preset length of the feed line 216 can be determined to minimize loss of dissolved gas from the carbonated water in the delivery passage and to avoid a state change into a frozen state before the carbonated water reaches the ice tray 206. For instance, the preset length of the feed line 216 can be between 5 and 30 cm.

In some implementations, the feed line 216 can include one or more curved or bent sections to reach the ice tray 206. For example, a first section 2161 of the feed line 216 can be disposed vertically below an upper surface of a side wall 2025 and extend from an inner side of the valve assembly 212 along the inner wall of the reservoir housing 202. A second section 2162 of the feed line 216 can be curved or bent upward from an end of the first section 2161 of the feed line 216 and extend over the upper surface of the side wall 2025. A third section 2163 of the feed line 216 can be curved or bent downward from an end of the section of the feed line 216 toward the ice tray 206. A length of the third section of the feed line 216 can be less than lengths of the first and second sections 2161, 2162 of the feed line 216 to avoid freezing of the carbonated water carried inside the feed line 216.

The ice maker 200 can further include a water line 230 connected to the reservoir 210 and configured to supply non-carbonated water to the reservoir 210, a gas line 232 connected to the reservoir 210 and configured to, based on the reservoir 210 receiving non-carbonated water, supply pressurized gas from the gas cartridge 208 to the reservoir 210 to thereby produce the carbonated water that is stored in the reservoir 210. For example, the water line 230 and the gas line 232 can include tubes or pipes that are disposed inside the reservoir 210 and extend along the axial direction of the reservoir 210. A length of the gas line 232 can be greater than a length of the water line 230 such that the gas line 232 supplies the pressurized gas in a deeper position of the reservoir 210 than the water line 230. In some cases, the length of the gas line 232 can be greater than the length of the first section 2161 of the feed line 216.

In some implementations, a front end of the gas cartridge 208 can protrude forward relative to the reservoir housing 202 to facilitate installation or replacement of the gas cartridge 208. For example, a front surface of the front cover 2024 can be spaced apart from the front end of the gas cartridge 208 by a predetermined distance D. In some cases, the predetermined distance D can indicate a predetermined installation position of the gas cartridge 208. In some implementations, a user can grab the protruded front end of the gas cartridge 208 and rotate the gas cartridge 208 into the connector 218. In some cases, the user can push the protruded front end of the gas cartridge 208 into the connector 218.

In some examples, the user can grab and rotate a bottom surface of the gas cartridge 208 that protrudes relative to a lowermost surface of the reservoir housing 202. The reservoir housing 202 and the ice tray housing 204 can be spaced apart from each other and define the accommodation space 207. In some cases, a lower portion of the accommodation space 207 is larger than an upper portion of the accommodation space 207 to accommodate the gas cartridge 208 and a hand of the user at the lower portion of the accommodation space 207.

In some implementations, the gas line 232 can include an injector nozzle configured to inject the pressurized gas from the gas cartridge 208 to non-carbonated water that is received in the reservoir 210 through the water line 230. For example, a cross-sectional area of the gas line 232 can decrease as the gas line 232 extends away from the valve assembly 212. That is, the cross-sectional area of the gas line 232 of a first end of the gas line 232 facing the valve assembly 212 can be greater than the cross-sectional area of the gas line 232 of a second end of the gas line 232 disposed away from the valve assembly 212 to thereby inject the pressurized gas in the non-carbonated water received in the reservoir 210.

The valve assembly 212 can include a plurality of valves. For example, the plurality of valves can include a first solenoid valve 2121 connected to the water line 230 and configured to supply non-carbonated water to the reservoir 210, a second solenoid valve 2122 connected to a vent port 234 (see FIG. 8) and configured to open the vent port 234 after the non-carbonated water and pressurized gas are supplied to the reservoir 210, and a third solenoid valve 2123 connected to the feed line 216 and configured to open the feed line 216 after a pressure of the undissolved gas is released from the reservoir 210 through the vent port 234. The first to third solenoid valves 2121, 2122, and 2123 can be arranged next to each other, and upper surfaces of first to third solenoid valves 2121, 2122, and 2123 can define a single plane that is recessed relative to an upper end of the valve assembly 212.

The valve assembly 212 can further include a gas dispense valve for controlling the injection of the pressurized gas. For example, the connector 218 can be the gas dispense valve and configured to control the injection of the pressurized gas (e.g., carbon dioxide) from the gas cartridge 208. In some examples, the gas dispense valve can include a solenoid valve connected to the gas line 232 and configured to supply the pressurized gas to the reservoir 210 after the reservoir 210 is filled with non-carbonated water and reaches a threshold temperature. In other examples, the gas dispense valve can be connected to the connector 218 and arranged adjacent to one of the first to third solenoid valves 2121, 2122, 2123 and define the single plane with the solenoid valves.

Figure 8:
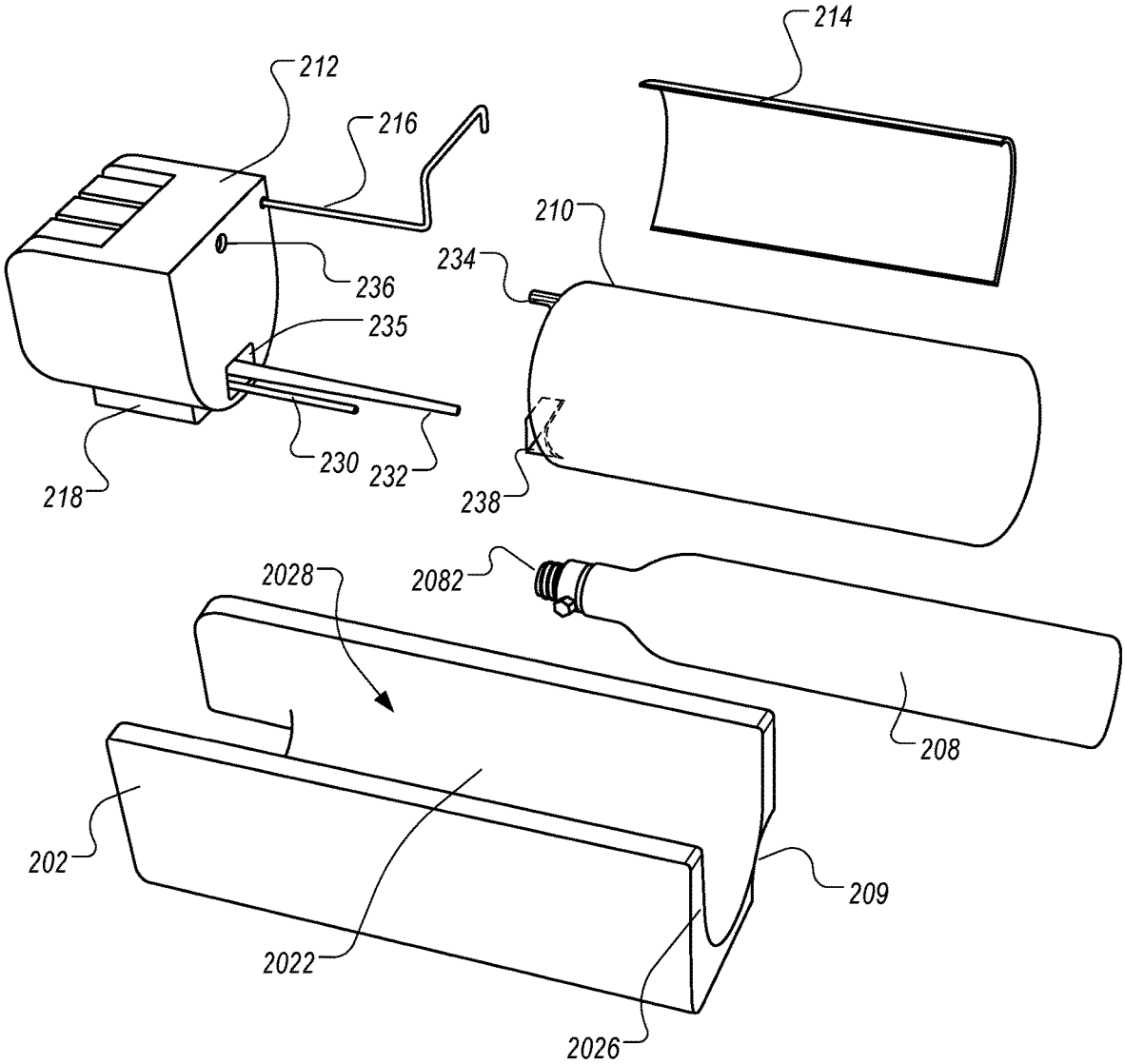
FIG. 8 is an exploded view illustrating the ice maker.

FIG. 8 is an exploded view illustrating example components of the ice maker 200.

In some implementations, the reservoir housing 202 can define the cartridge groove 209 at a bottom corner, an upper opening 2022 at an upper side, a front opening 2026 at a front side, and a reservoir groove 2028 configured to receive the reservoir 210. For example, an upper portion of the reservoir 210 can be exposed through the upper opening 2022, and a front end of the reservoir 210 can be exposed through the front opening 2026. In some implementations, the front cover 2024 (see FIG. 6A) can be disposed at and block the front opening 2026. In some examples, the reservoir groove 2028 can be a part of an insulated space that is defined between the ceiling surface 42 of the freezing compartment 4 and the reservoir housing 202, the insulated space can be surrounded by the reservoir housing 202 and the ceiling surface 42. The heating element 214 can be configured to provide heat to the reservoir groove 2028 and the outer surface of the reservoir 210.

In some examples, an inner surface of the valve assembly 212 can define a vent hole 236 configured to receive the vent port 234 of the reservoir 210 and a coupling hole 235 configured to receive a coupling protrusion 238 of the of the reservoir 210. The feed line 216 is connected to the inner surface of the valve assembly 212 and extends away from the valve assembly 212. The water line 230 and the gas line 232 can pass through the coupling hole 235 and be inserted into the reservoir 210 through the coupling protrusion 238. For instance, the coupling protrusion 238 can define introduction holes configured to receive the water line 230 and the gas line 232 into the interior of the reservoir 210.

The vent port 234 and the coupling protrusion 238 can protrude from a rear surface of the reservoir 210 facing the inner surface of the valve assembly 212. The vent port 234 can be located at an upper portion of the reservoir 210, for example, vertically above the water line 230 and the gas line 232, where the vent port 234 is configured to discharge the pressurized gas that is released from or not dissolved in the carbonated water in the reservoir 210.

In some implementations, the gas cartridge 208 can include an outlet end 2082 configured to be inserted into the connector 218 by rotation. For example, the outlet end 2082 can have a first thread that is defined at an outer surface of the outlet end 2802, and the connector 218 can have a second thread that is defined at an inner surface of the connector 218 and configured to engage with the first thread of the outlet end 2082. In some examples, the outlet end 2082 and the connector 218 can be coupled to each other by a tight fit based on friction between the outlet end 2082 and the connector 218.

Figure 9:
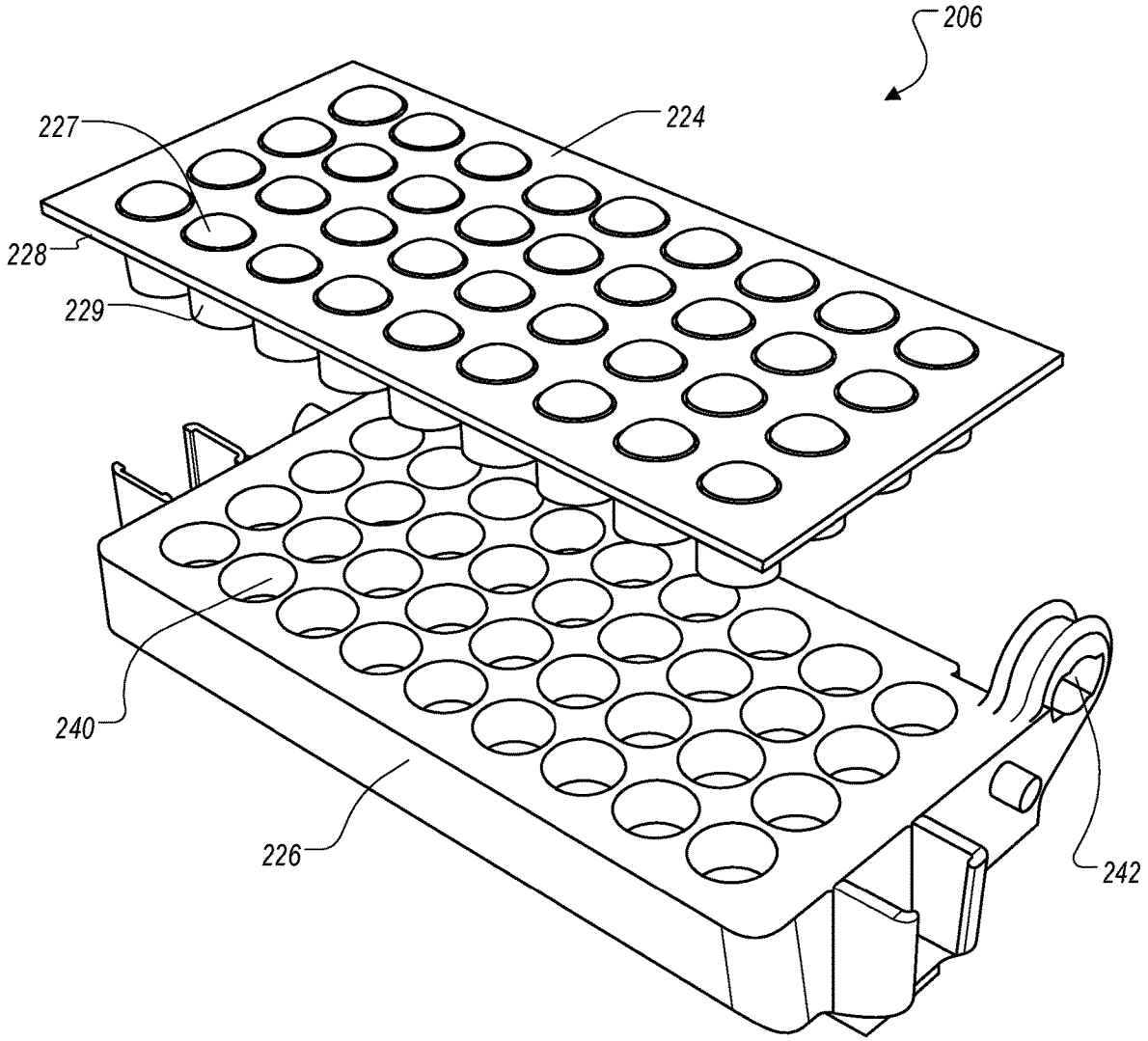
FIG. 9 is a perspective view illustrating an example of the ice tray.

FIG. 9 is a perspective view illustrating an example of the ice tray 206. For example, the ice tray 206 can include an upper tray 224 and a lower tray 226 that is disposed vertically below the upper tray 224 and supports the upper tray 224. The upper tray 224 can define a plurality of ice cells 227 (e.g., grooves or recesses) that are configured to receive the carbonated water from the reservoir 210 and define a shape of carbonated ice pieces. For instance, each of the ice cells 227 can have a cylindrical shape to produce the carbonated ice piece having the cylindrical shape. In some implementations, the upper tray 224 can include a plate portion 228 and a plurality of cell protrusions 229 that protrude downward from a lower surface of the plate portion 228 and define the plurality of ice cells 227, respectively. Each of the cell protrusions 229 can have a cylindrical shape corresponding to the shape of the ice cell 227.

In some examples, at least a portion of the upper tray 224 can be made of a flexible material such as silicone or rubber and configured to deform based on external force applied to eject the carbonated ice pieces from the upper tray 224. For example, in some examples, an entirety of the upper tray 224 can be made of a flexible material and integrally formed in a manufacturing process such as injection molding. In some cases, the cell protrusions 229 can be made of a flexible material, and the plate portion 228 can be made of a rigid material such as a plastic material that is more rigid than the flexible material of the cell protrusions 229.

In some implementations, the lower tray 226 can define a plurality of through-holes 240 that are configured to receive the plurality of cell protrusions 229, respectively. The lower tray 226 can be made of a rigid material such as a plastic material that is more rigid than the flexible material of the upper tray 224. Each cell protrusion 229 can be configured to pass through one of the through-holes 240 based on the upper tray 224 being mounted on the lower tray 226.

In some examples, referring to FIGS. 5 and 9, bottom surfaces of the cell protrusions 229 can protrude downward relative to a lower surface of the lower tray 226 such that the bottom surfaces of the cell protrusions 229 are exposed outside the through-holes 240. Based on the lower tray 226 rotating toward the ejector panel 220, each of the ejector pins 222 can contact and push the exposed bottom surface of one of the cell protrusions 229. The cell protrusions 229, which are made of a flexible material, can deform away from the ejector pins 222 by external force applied by the ejector pins 222 and move the carbonated ice out of the ice cells 227.

In some cases, the bottom surfaces of the cell protrusions 229 can remain inside the through-holes 240, and the ejector pins 222 can have a length or a shape to reach the bottom surfaces of the cell protrusions 229 based on the lower tray 226 rotating toward the ejector panel 220.

In some implementations, the lower tray 226 can include a pivot support 242 that is located at one side of the lower tray 226 and defines a rotation axis of the lower tray 226. For example, the pivot support 242 can protrude from an upper side of the lower tray 226 in a direction away from the reservoir housing 202. In some examples, the pivot support 242 can define a shaft opening that receives a rotation shaft configured to rotate the lower tray 226 toward the ejector panel 220 about the rotation axis such that the ejector pins 222 can push the cell protrusions 229.

Figure 10:
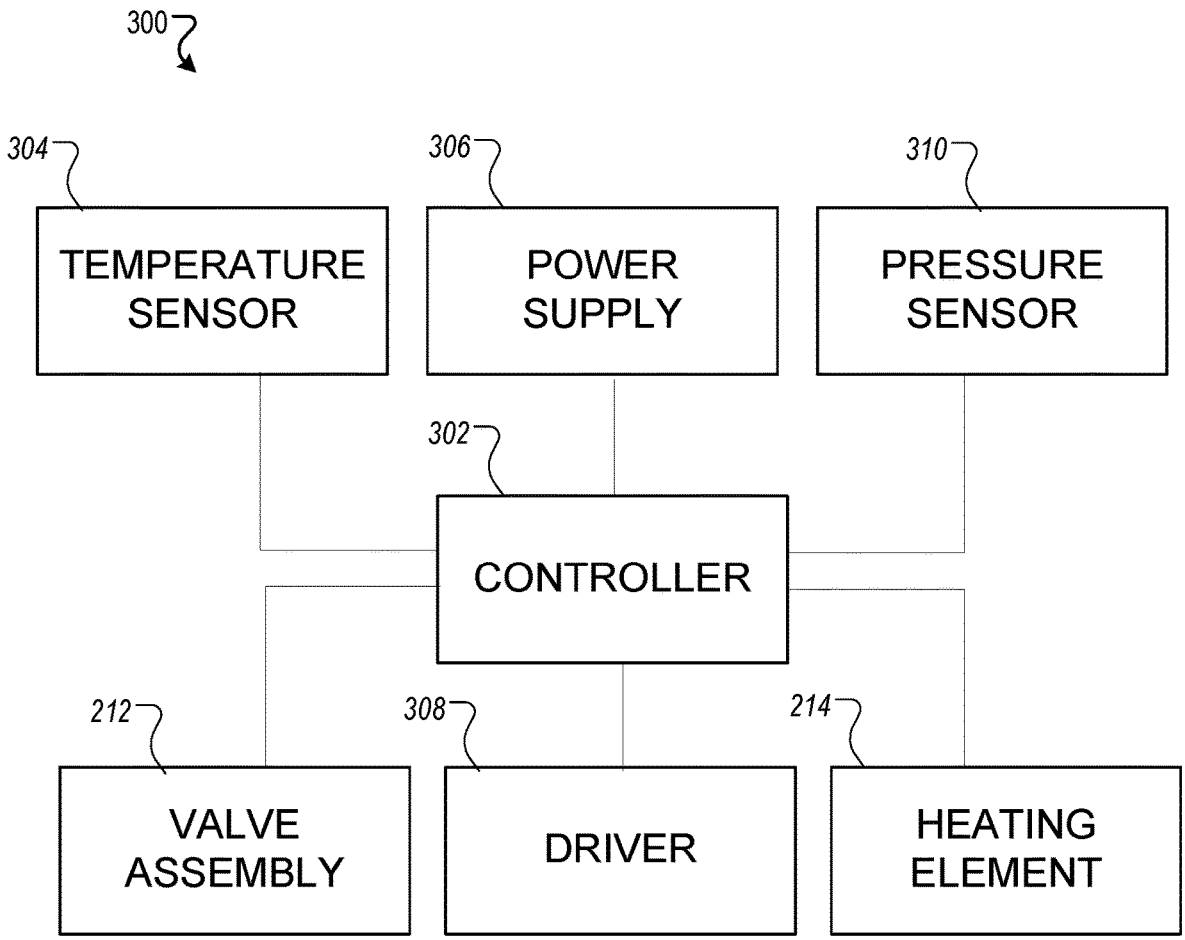
FIG. 10 is a block diagram of an example system for controlling the ice maker.

FIG. 10 is a block diagram illustrating an example of a control system 300 for controlling the ice maker 200. For example, the control system 300 can include a controller 302, a temperature sensor 304, a power supply 306, a driver 308, the heating element 214, and the valve assembly 212. In some examples, the control system 300 can further include a pressure sensor 310. The controller 302 can be operably or physically connected to and control each of the temperature sensor 304, the power supply 306, the driver 308, the heating element 214, the valve assembly 212, and the pressure sensor 310. In some examples, the controller 302 can include an electrical circuit, one or more processors such as microprocessors, or the like, and the controller 302 can control operation of the ice maker 200. For instance, the controller 302 can be configured to control each of the solenoid valves of the valve assembly 212. In some cases, the control system 300 can also control an overall operation of the refrigerator 1.

The temperature sensor 304 can be disposed at the reservoir housing 202 configured to detect a reservoir temperature of the reservoir 210. In some examples, the temperature sensor 304 can be mounted directly to the reservoir 210 and configured to provide the reservoir temperature to the controller 302.

The power supply 306 can be configured to supply power to the controller 302 for operation of the controller 302. In some implementations, the power supply 306 can supply power to the valve assembly 212 and the heating element 214 based on control of the controller 302. The power supply 306 can be disposed in the refrigerator 1 and include an electric circuit connected to an external power source such as an electrical wall outlet.

The driver 308 can include an electric motor configured to generate torque and one or more gears configured to transfer the torque to the ice tray 206. For instance, the driver 308 can be disposed at the ice tray housing 204 and configured to rotate the rotation shaft passing through the pivot support 242 (see FIG. 9). The driver 308 can rotate the ice tray 206 from a first position in which the carbonated ice is generated to a second position in which the carbonated ice is ejected. In some implementations, the driver 308 can also rotate the ice tray from the second position to the first position based on completing ejection of the carbonated ice from the ice tray 206.

In some implementations, the controller 302 can be configured to turn on and off the heating element 214 based on the reservoir temperature measured by the temperature sensor 304. For example, the controller 302 can be configured to turn on the heating element 214 based on the reservoir temperature being less than a threshold temperature. For instance, the threshold temperature can be equal to a freezing temperature of carbonated water (e.g., 0° C. or slightly less than 0° C. as described above). In some examples, the controller 302 can be further configured to turn off the heating element 214 based on the reservoir temperature being greater than or equal to a reference temperature above the threshold temperature.

In some implementations, the heating element 214 can be configured to, alternatively or in addition to being turned on and off, adjust heat output by the controller 302 based on the reservoir temperature measured by the temperature sensor 304. For example, the controller 302 can be configured to increase the heat output of the heating element 214 based on the reservoir temperature being less than the threshold temperature. In some examples, the controller 302 can be further configured to decrease the heat output of the heating element 214 based on the reservoir temperature being greater than or equal to the reference temperature.

Figure 11:
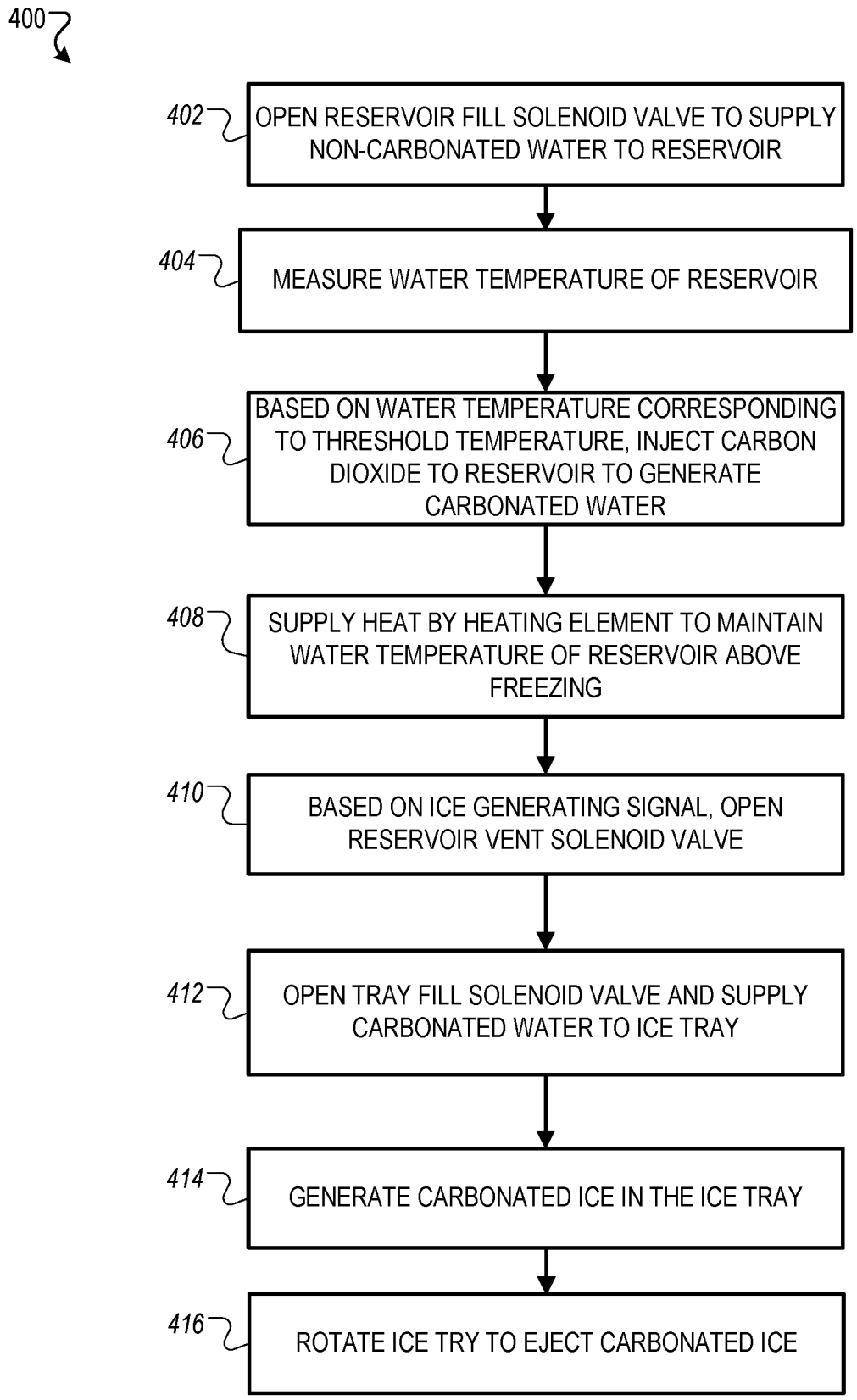
FIG. 11 is a flow chart of an example process for generating carbonated ice.

FIG. 11 is a flow chart illustrating an example process 400 for generating carbonated ice. For example, the controller 302 can be configured to perform the process 400. Specifically, the process 400 can include operation 402 for opening a reservoir fill valve (e.g., first solenoid valve 2121) to supply non-carbonated water to the reservoir 210 and operation 404 for measuring a water temperature (reservoir temperature) of the reservoir 210. For example, the water temperature can be measured by the temperature sensor 304.

In some implementations, the non-carbonated water can be pre-chilled in another reservoir and provided to the reservoir 210 based on control of the controller 302. For instance, the refrigerator 1 can include a first reservoir that is disposed at the refrigerating compartment door 5 and a second reservoir (e.g., reservoir 210) that is disposed in the freezing compartment 4. The first reservoir can be configured to store non-carbonated water such as filtered water or pure water and to pre-chill the non-carbonated water to a first temperature to thereby supply the pre-chilled water to the second reservoir based on a control signal of the controller 302. In some examples, the dispenser 7 can discharge the pre-chilled water to an outside of the cabinet 2.

The pre-chilled water stored in the first reservoir can have the first temperature that is greater than 0° C. (e.g., 3° C. to 12° C.), and the temperature of the pre-chilled water can further decrease as the pre-chilled water is supplied to the reservoir 210 through one or more pipes that extend to the freezing compartment 4. In addition, the non-carbonated water in the reservoir 210, i.e., the pre-chilled water received in the reservoir 210, can be further cooled to a second temperature less than the first temperature by cooling air in the freezing compartment 4.

In some implementations, the process 400 can further include operation 406 for comparing the water temperature in the reservoir 210 with a threshold temperature (e.g., 0°) C. and injecting carbon dioxide to the reservoir 210 to generate carbonated water in the reservoir 210 based on the water temperature corresponding to the threshold temperature. For example, the controller 302 can be configured to open the gas dispense valve (e.g., connector 218) to supply carbon dioxide to the reservoir 210 when the water temperature in the reservoir 210 becomes greater than or equal to the threshold temperature such that the non-carbonated water in the reservoir 210 maintains the liquid state before injecting carbon dioxide. The threshold temperature can be slightly above 0° C. (e.g., 0.1 to 1° C.) to maximize the solubility and concentration of carbon dioxide dissolved in the water while maintaining the liquid state. In some cases, the threshold temperature can be adjusted to above 0° C., for example, between 1-5° C., in accordance with a user preference of the carbonation degree in the carbonated ice.

In some implementations, the process 400 can further include operation 408 for controlling the heating element 214 to supply heat to the reservoir 210 to maintain the water temperature of the reservoir 210 above freezing. For example, the controller 302 can be configured to turn on the heating element 214 based on the water temperature of the reservoir 210 being less than a lower limit temperature that is set to be less than or equal to the threshold temperature. The controller 302 can be configured to turn off the heating element 214 based on the water temperature of the reservoir 210 being greater than or equal to an upper limit temperature that is set to be greater than or equal to the threshold temperature. Alternatively, or in addition, the controller 302 can be configured to variably control an amount of heat of the heating element 214 to keep the water temperature in the reservoir 210 within a temperature range between the upper limit temperature and lower limit temperature.

In some implementations, the process 400 can further include operation 410 for opening a reservoir vent valve (e.g., second solenoid valve 2122) to release undissolved gas pressure in the reservoir 210 to an ambient room air pressure based on an ice generating signal. For example, the controller 302 can be configured to receive information regarding an amount of carbonated ice stored in an ice bin and to generate the ice generating signal based on the amount of carbonated ice being less than a reference amount. In some cases, the controller 302 can generate the ice generating signal based on a user input that indicates discharge of carbonated ice such that the ice maker 200 can refill the ice bin with more carbonated ice after the carbonated ice is discharged. In some cases, the controller 302 can include a counter and generate the ice generating signal based on a count of ice discharging events being greater than or equal to a reference number.

In some implementations, one or more of the operations 402, 404, and 408 can also be performed based on the controller 302 receiving the ice generating signal. For example, the controller 302 can open the reservoir fill solenoid valve based on receiving the ice generating signal. In some cases, the controller 302 can be configured to inject carbon dioxide to the reservoir 210 based on receiving the ice generating signal and determining that the water temperature corresponding to the threshold temperature. In some cases, the operation 410 can include sensing, by the pressure sensor 310, a pressure inside the reservoir 210 while or after opening the reservoir vent valve to thereby determine whether the pressure becomes equal to the ambient room air pressure.

In some implementations, the process 400 can further include operation 412 for opening a tray fill valve (e.g., third solenoid valve 2123) to supply carbonated water to the ice tray 206 after releasing the gas pressure in the operation 410. In some examples, the controller 302 can be configured to open the tray fill valve for a predetermined duration such that a predetermined amount of carbonated water can be supplied to the ice tray 206. For example, the volume of the reservoir 210 can be equal to the volume of the ice tray 206 (e.g., a summation of volumes of the ice cells 227) such that all of the carbonated water in the reservoir 210 is supplied to the ice tray 206 at each ice generating cycle. This can help to minimize bacteria reproduction within the reservoir 210 by providing fresh carbonated water at each ice generating cycle. In addition, emptying the reservoir 210 at each ice generating cycle can help to minimize loss of carbonation while the carbonated water is stored in the reservoir 210.

In some implementations, the process 400 can further include operation 414 for generating carbonated ice in the ice tray 206 from the received carbonated water. For example, the ice tray 206 can be disposed in the ice tray housing 204 that is in fluid communication with the freezing compartment 4. Specifically, as shown in FIG. 3, the ice tray housing 204 can have an open bottom surface that is exposed to the freezing compartment 4, where the ejector panel 220 extends downward and passes through the open bottom surface of the ice tray housing 204. The carbonated water received in the ice tray 206 can be frozen by cooling air in the freezing compartment 4 and turned into carbonated ice that is more chewable or porous than ice generated from pure water or non-carbonated water. The carbonated ice can include bubbles of carbon dioxide that are released from the carbonated water and trapped in the ice during the ice generating process.

In some implementations, the process 400 can further include operation 416 for ejecting the generated carbonated ice by rotating the ice tray 206. For instance, as described above with FIG. 5, the controller 302 can be configured to rotate the ice tray 206 toward the ejector panel 220 after generating the carbonated ice. For example, the controller 302 can be configured to rotate the ice tray 206 based on an elapse of a predetermined time since having received the carbonated water to the ice tray 206. In some cases, the ice maker 200 can include a sensor configured to detect completion of ice generation. For example, the ice maker 200 can include a temperature sensor that can measure a cell temperature of carbonated water and ice received in the ice cells 227. The controller 302 can be configured to determine a completion of ice generation based on the cell temperature corresponding to a predetermined temperature corresponding to carbonated ice. In some examples, the controller 302 can be configured to rotate the ice tray 206 based on a predetermined cycling motion of the driver 308 that is synchronized with one or more of the operations of the ice generation process 400. For instance, the driver 308 can include a cam that has a shape configured to rotate the rotating shaft of the ice tray 206 at a predetermined cycle corresponding to one or more of the operations 402 to 416.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines a refrigerating compartment and a freezing compartment; and an ice maker located at the freezing compartment and configured to generate carbonated ice, the ice maker comprising:

a reservoir configured to store carbonated water that includes dissolved gas, a water line connected to the reservoir and configured to supply non-carbonated water to the reservoir, a gas line connected to the reservoir and configured to, based on the reservoir receiving the non-carbonated water, supply pressurized gas to the reservoir to thereby produce the carbonated water that is stored in the reservoir, a heating element configured to heat the reservoir to a temperature above a freezing temperature of the carbonated water, and an ice tray configured to receive the carbonated water from the reservoir and to generate carbonated ice, wherein the ice maker further comprises:

a reservoir housing that defines a reservoir groove configured to accommodate the reservoir and a cartridge groove configured to accommodate a gas cartridge that includes the pressurized gas, and a feed line that is connected to the reservoir housing and extends to the ice tray, the feed line being configured to supply the carbonated water to the ice tray, wherein the feed line is configured to receive heat generated from the heating element, wherein the heating element comprises a heating pad that is attached to an outer surface of the reservoir, the heating pad facing an inner wall of the reservoir housing that faces the ice tray, and wherein at least a portion of the feed line (i) is disposed inside the reservoir housing, (ii) extends along the inner wall of the reservoir housing and the heating pad, and (iii) overlaps with a portion of the heating pad to thereby receive heat generated from the heating pad.

2. The refrigerator of claim 1, wherein the pressurized gas comprises carbon dioxide.

3. The refrigerator of claim 1, wherein the reservoir comprises a vent port configured to discharge undissolved gas from the reservoir.

4. The refrigerator of claim 3, further comprising:

a valve assembly disposed at the reservoir housing and configured to control (i) supply of the non-carbonated water to the reservoir through the water line, (ii) supply of the pressurized gas to the reservoir through the gas line, (iii) supply of the carbonated water to the ice tray through the feed line, and (iv) discharge of the undissolved gas from the reservoir.

5. The refrigerator of claim 4, wherein the vent port is inserted into the valve assembly, and wherein the valve assembly comprises:

a reservoir fill valve connected to the water line, a gas dispense valve connected to the gas cartridge and the gas line and configured to open the gas cartridge or the gas line based on the reservoir receiving the non-carbonated water and a temperature of the reservoir being greater than or equal to a threshold temperature, a reservoir vent valve connected to the vent port and configured to open the vent port to release the undissolved gas in the reservoir, and a tray fill valve connected to the feed line and configured to open the feed line based on a pressure of the undissolved gas discharged from the reservoir through the vent port.

6. The refrigerator of claim 1, wherein the reservoir groove of the reservoir housing is recessed downward relative to an upper surface of the reservoir housing facing a ceiling of the freezing compartment, wherein the reservoir groove is an insulated space that is defined between the ceiling of the freezing compartment and the reservoir housing, the insulated space being surrounded by the reservoir housing, and wherein the heating element is configured to provide heat to the insulated space.

7. The refrigerator of claim 6, wherein the cartridge groove is recessed upward relative to a lower surface of the reservoir housing that is spaced apart from the ceiling of the freezing compartment, and wherein the reservoir housing is configured to accommodate an upper portion of the gas cartridge in a state in which a lower portion of the gas cartridge is exposed to the freezing compartment.

8. The refrigerator of claim 1, wherein the ice tray defines a plurality of ice cells configured to receive the carbonated water and to form the carbonated ice in a cylindrical shape.

9. The refrigerator of claim 8, wherein the ice tray is made of silicone.

10. The refrigerator of claim 8, wherein the ice maker further comprises an ejector panel that extends downward relative to a bottom surface of the ice tray, the ejector panel comprising a plurality of pins that extends toward the reservoir, wherein the ice tray is configured to rotate toward the ejector panel, and wherein the plurality of pins is configured to push the bottom surface of the ice tray based on the ice tray rotating toward the ejector panel to thereby release the carbonated ice from the ice tray.

11. The refrigerator of claim 8, wherein a volume of the reservoir corresponds to a volume of the plurality of ice cells.

12. The refrigerator of claim 1, wherein the reservoir housing extends in a direction toward a rear surface of the cabinet and is configured to receive the gas cartridge in the direction toward the rear surface of the cabinet, the reservoir housing being configured to hold the gas cartridge in a state in which a front end of the gas cartridge protrudes outside the reservoir housing toward a door of the freezing compartment.

13. The refrigerator of claim 1, wherein a carbonation ratio of a gas weight of the dissolved gas with respect to a liquid volume of the carbonated water stored in the reservoir is greater than or equal to 2.5 g/L.

14. The refrigerator of claim 13, wherein the heating element is configured to control an amount of heat supplied to the reservoir to control the carbonation ratio by maintaining a temperature of the reservoir to be greater than the freezing temperature of the carbonated water.

15. The refrigerator of claim 1, wherein the reservoir housing defines an upper opening that faces a ceiling of the freezing compartment, and wherein at least a portion of the heating element is exposed to the upper opening and faces the ceiling of the freezing compartment.

16. The refrigerator of claim 15, wherein the reservoir housing further defines a front opening configured to receive the reservoir, and wherein the ice maker further comprises a front cover configured to cover a front side of the reservoir that is received in the reservoir housing.

17. The refrigerator of claim 16, wherein the front cover is configured to be positioned rearward relative to a front end of the gas cartridge.

18. The refrigerator of claim 1, wherein the reservoir has a cylindrical shape, wherein the heating pad is curved along an outer circumferential surface of the reservoir and extends in an axial direction of the reservoir, and wherein the portion of the feeding line extends in the axial direction of the reservoir.

* * * * *